United States Patent [19]

Arlt

[11] Patent Number: 4,608,925

[45] Date of Patent: Sep. 2, 1986

[54] SHEET TRANSFER CYLINDER IN SHEET-FED ROTARY PRINTING MACHINES

[75] Inventor: Manfred Arlt, Heidelberg, Fed. Rep. of Germany

[73] Assignee: Heidelberger Druckmaschinen AG, Heidelberg, Fed. Rep. of Germany

[21] Appl. No.: 766,772

[22] Filed: Aug. 16, 1985

[30] Foreign Application Priority Data

Aug. 16, 1984 [DE] Fed. Rep. of Germany ..... 3430131

[51] Int. Cl.[4] ..... B41F 21/10; B41L 21/06

[52] U.S. Cl. ..... 101/411; 101/420

[58] Field of Search ..... 101/409, 410, 411, 412, 101/420, 246, 415.1, 230, 231, 375, 376; 271/314, 315, 81, 82, 83, 204

[56] References Cited

U.S. PATENT DOCUMENTS 4,004,512 1/1977 Jeschke ..... 101/410

4,024,814 5/1977 Becker ..... 101/410

4,122,773 10/1978 Wirz ..... 101/230

*Primary Examiner*—J. Reed Fisher

*Attorney, Agent, or Firm*—Herbert L. Lerner; Laurence A. Greenberg

[57] ABSTRACT

In sheet-fed rotary printing machines, a sheet transfer cylinder having a sheet-bearing cylinder jacket formed of a plurality of jacket segments arranged next to one another in circumferential direction of the cylinder, the jacket segments extending at least over a sheet-bearing circumferential area of the sheet transfer cylinder, includes locking elements located at respective ends of the jacket segments and engaging in corresponding receiving elements on end surfaces of the cylinder, the locking elements being a pair of guide cams located at each end of the jacket segments, and the receiving elements being receiving grooves formed concentrically in a support disc defining an end surface of the cylinder, the guide cams being guided in circumferential direction of the cylinder and lockable in the receiving grooves.

21 Claims, 17 Drawing Figures

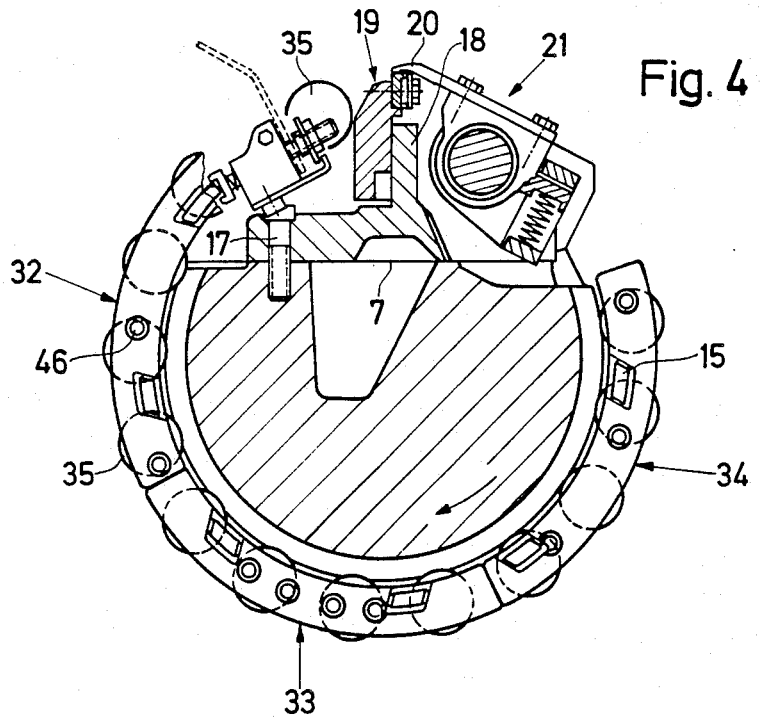
Fig. 4
Fig. 5
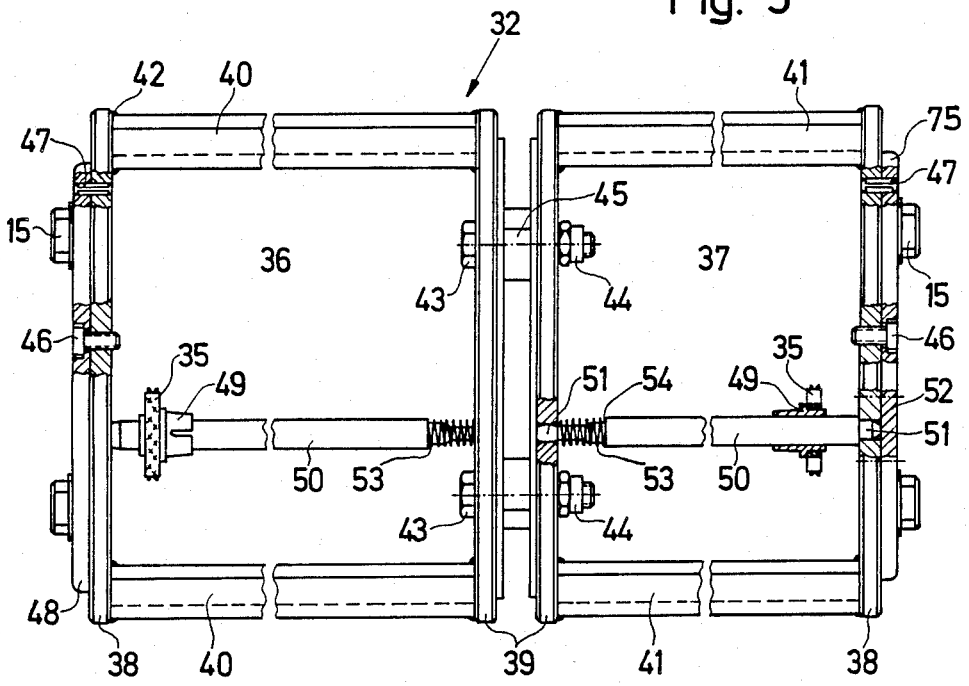

SHEET TRANSFER CYLINDER IN SHEET-FED ROTARY PRINTING MACHINES

The invention refers to a sheet transfer cylinder in rotary sheet printing machines having a sheet-bearing cylinder jacket formed of a plurality of jacket segments arranged next to one another in circumferential direction of the cylinder, the jacket segments extending at least over a sheet-bearing circumferential area of the sheet transfer cylinder.

Such sheet transfer cylinders are in use in various different forms. Depending upon the position and special function within the printing machine, sheet transfer cylinders are known, in particular, which have a close cylindrical jacket which, if necessary or desirable, has a special sheet-bearing structure. An embodiment which is also well known, instead of a more surface-to-surface type of support for the paper sheet, is a mainly pointwise support or contact which is achieved by providing small individual rowels or similar acting elements in the surface of the cylinder jacket.

In this manner, it is possible, by the use of a correspondingly constructed cylinder jacket, that the machine operator can adapt the machine to the individual operating conditions which occur as a result of the varying printing job requirements. Such changes in operating conditions are normally indicated by a varying structure of the printed image, a change with regard to format or quality and thickness of the printing material, as well as by a changing machine operation between first form or both single side and perfector printing.

The state of the art referred to is determined by correspondingly formed sheet transfer cylinders in printing machines of the corporate assignee of the instant application. Sheet-bearing jacket elements are thus provided which, for example, have at the end faces thereof locking pins which engage in corresponding bores formed in end faces of the cylinder, a large number of the bores being provided at given spaced distances from one another so that each jacket element can be optionally disposed over the circumference of the sheet transfer cylinder.

The positioning is possible, however, only stepwise in accordance with the distance between the individual bores.

By using jacket elements which are constructed in the form of jacket segments with a closed sheet bearing surface extending over a part of the circumference of the cylinder jacket, and taking various production tolerances into consideration, gaps which have a negative effect upon the printing process can occur in longitudinal direction on the cylinder jacket between the individual jacket segments. Furthermore, the type of mounting (inclined entry) requires a given difference in diameter (clearance) between locking pins and bores so that a deviation or error in concentricity of the cylinder jacket formed out of the jacket elements results. This also has negative effects upon the printing result.

Based on this state of the art, it is according an object of the invention to provide a sheet transfer cylinder which avoids these disadvantages and at the same time can be adjusted more flexibly and extremely easily and quickly to various operating conditions, such as different structure of the printed image, change of the printing material with respect to format, quality and thickness and/or changing machine operation between single side and both first form and perfector printing, while additionally always ensuring trouble-free sheet movement which does not impair the quality of the print pattern or printed image and the material on which printing is to be effected.

With the foregoing and other objects in view, there is provided in accordance with the invention, in sheet-fed rotary printing machines, a sheet transfer cylinder having a sheet-bearing cylinder jacket formed of a plurality of jacket segments arranged next to one another in circumferential direction of the cylinder, the jacket segments extending at least over a sheet-bearing circumferential area of the sheet transfer cylinder, includes locking elements located at respective ends of the jacket segments and engaging in corresponding receiving elements on end surfaces of the cylinder, the locking elements being a pair of guide cams located at each end of the jacket segments, and the receiving elements being receiving grooves formed concentrically in a support disc defining an end surface of the cylinder, the guide cams being guided in circumferential direction of the cylinder and lockable in the receiving groves.

In accordance with a further feature of the invention there are provided, radial entry slots for facilitating the insertion of the guide cams in the receiving grooves formed in the support discs at both ends of the cylinder, the radial entry slots, respectively, being arranged in accordance with the spacing and the width of the guide cams.

In accordance with an additional feature of the invention there are provided, stationary stop means at which each of the jacket segments guided in the receiving grooves is bringable to rest.

In accordance with an added feature of the invention there is provided a previously inserted one of the jacket segments at which each of the remaining jacket segments guided in the receiving grooves is bringable to rest.

In accordance with yet another feature of the invention there are provided locking elements via which each of the jacket segments is fixable at a given location of the circumference of the sheet transfer cylinder.

In accordance with yet a further feature of the invention there is provided in a sheet-fed rotary printing machine, a sheet transfer cylinder having a sheet-bearing cylinder jacket formed of a plurality of jacket segments arranged next to one another in circumferential direction of the cylinder, the jacket segments extending at least over a sheet-bearing circumferential area of the sheet transfer cylinder, includes guide cams located at respective ends of the jacket segments and engaging in corresponding receiving grooves formed concentrically in respective support discs defining end surfaces of the cylinder, the guide cams being guided in circumferential direction of the cylinder and lockable in the receiving grooves, the jacket segments forming the cylinder jacket being mutually exchange- able.

In accordance with yet an additional feature of the invention, the jacket segments forming the cylinder jacket are of like type with respect to the sheet-carrying area thereof and are mutually exchangeable.

In accordance with yet an added feature of the invention, the jacket segments forming the cylinder jacket are of different types with respect to the sheet-carrying area thereof and are mutually exchangeable.

In accordance with yet an alternate feature of the invention, the sheet-bearing circumferential area is on a part of the jacket segments and constitutes a surface closed upon itself.

In accordance with still another feature of the invention, the sheet-bearing circumferential area is on a part of the jacket segments constructed so as to bear the sheet only on given points.

In accordance with still a further feature of the invention, the cylinder jacket is formed of an arbitrarily selected sequence and number of the jacket segments defining a closed surface having points thereon on which exclusively the sheets are supported.

In accordance with still an additional feature of the invention, each of the jacket segments is formed of a radially outer jacket and a radially inner jacket spaced from one another and mutually connected by a connecting web, and respective ring segments carrying said guide cams and being threadedly fastened to end faces of the cylinder jacket.

In accordance with still an added feature of the invention there is provided a sheet gripping device mounted in a channel extending axially along the jacket segments and wherein respective belts are associated on both sides with each of the inner jackets of the jacket segments, and being fastened at one end thereof by rivets to the inner jackets and suspended at the other end thereof from a pin located in vicinity of the sheet gripping device.

In accordance with again another feature of the invention, each of the jacket segments includes a pair of mutually connected segment sections formed as a frame and including, respectively, two circular discs disposed at opposite sides of the jacket segments and being mutually secured by connecting webs, and a respective further disc carrying the guide cams, the further disc being fastened to at least one of the circular discs of each of the jacket segments.

In accordance with again a further feature of the invention, the two circular discs disposed at opposite sides of each of the jacket segments are formed with corresponding bores wherein locking pins of respective carrier rods are received, a plurality of sheet-bearing rowels being disposed on the carrier rods and being shiftable longitudinally via bearing bushings.

In accordance with an additional feature of the invention there is provided in a sheet-fred rotary printing machine, a sheet transfer cylinder having a sheet-bearing cylinder jacket formed of a plurality of jacket segments arranged next to one another in circumferential direction of the cylinder, the jacket segments extending at least over a sheet-bearing circumferential area of the sheet transfer cylinder, comprising guide cams located at respective ends of the jacket segments and engaging in corresponding receiving grooves formed concentrically in respective support discs defining end surfaces of the cylinder, said guide cams being guided in circumferential direction of the cylinder and lockable in said receiving grooves, and respective clamping devices assigned to each of said support discs for pressing the jacket segments against one another in circumferential direction of the cylinder and for pressing a last one of the jacket segments in a sequence of the jacket segments against respective stops.

In accordance with an added feature of the invention, each of the clamping devices is constructed as a turnbuckle pivotable selectively about a given pivot axis into a release position permitting displaceability of the jacket segments in circumferential direction of the cylinder and into a working position wherein the jacket segments are pressed by spring bias against corresponding stops.

In accordance with a further aspect of the invention, the turnbuckle has a spring-loaded clamping plate pressing against the guide cams, the turnbuckle has a stop for preventing automatic release of the turnbuckle from the working position thereof and for absorbing inertial forces directed in circumferential direction of the cylinder.

In accordance with another feature of the invention, the turnbuckle has a body rotatably fastened to the respective support disc by a bolt having a longitudinal axis corresponding to the pivot axis and a locknut threadedly received on the bolt, and a clamping rod projecting through a bore formed in the turnbuckle body, the clamping rod being formed with a recess and having the spring-loaded clamping plate at one end thereof and being formed with a thread at the other end thereof whereon a knurled nut is threadedly secured.

In accordance with a further feature of the invention there is provided a plate 69 fastened by a bolt and a positioning pin to an underside of the turnbuckle body and formed with an end piece bent perpendicularly to the plate and serving as a stop for the knurled nut, inertial forces present in the reaction force of the jacket segments being directly transmitted via the clamping plate, the clamping rod and the knurled nut to the end piece.

In accordance with a concomitant feature of the invention there is provided a fork-shaped clamping lever receivable in an intermediate space between the knurled nut and an end face of the turnbuckle body for actuating the turnbuckle. Other features which are considered as characteristic for the invention are set forth in the appended claims.

Although the invention is illustrated and described herein as embodied in sheet transfer cylinder in sheet-fed rotary machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which:

FIG. 4 is another cross-sectional view of a sheet transfer cylinder with cylinder jacket segments thereof supporting a sheet only at points;

FIG. 5 is a longitudinal view of one of the jacket segments shown in FIG. 4;

Figure 2:
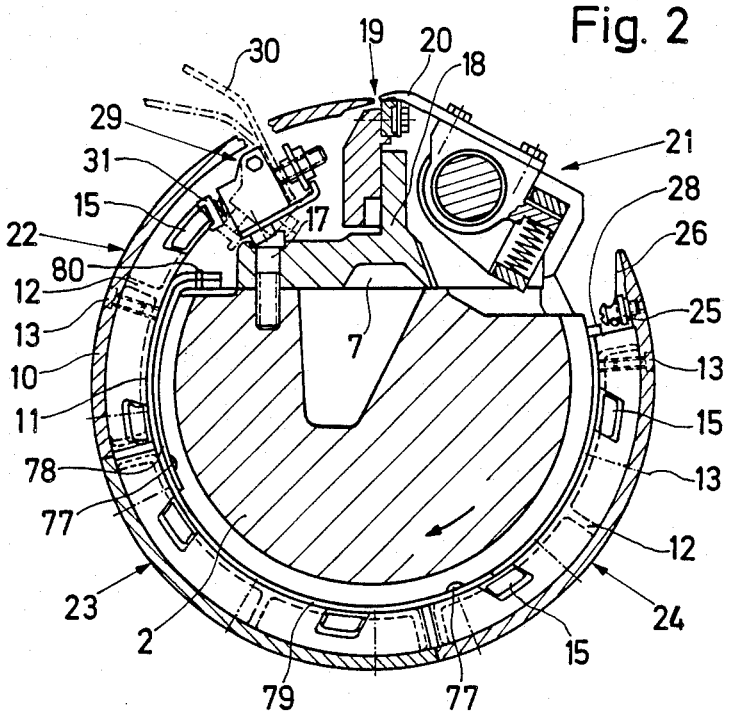
FIG. 2 is a cross-sectional view of FIG. 1 taken along the line 2—2 in direction of the arrows.
Figure 1:
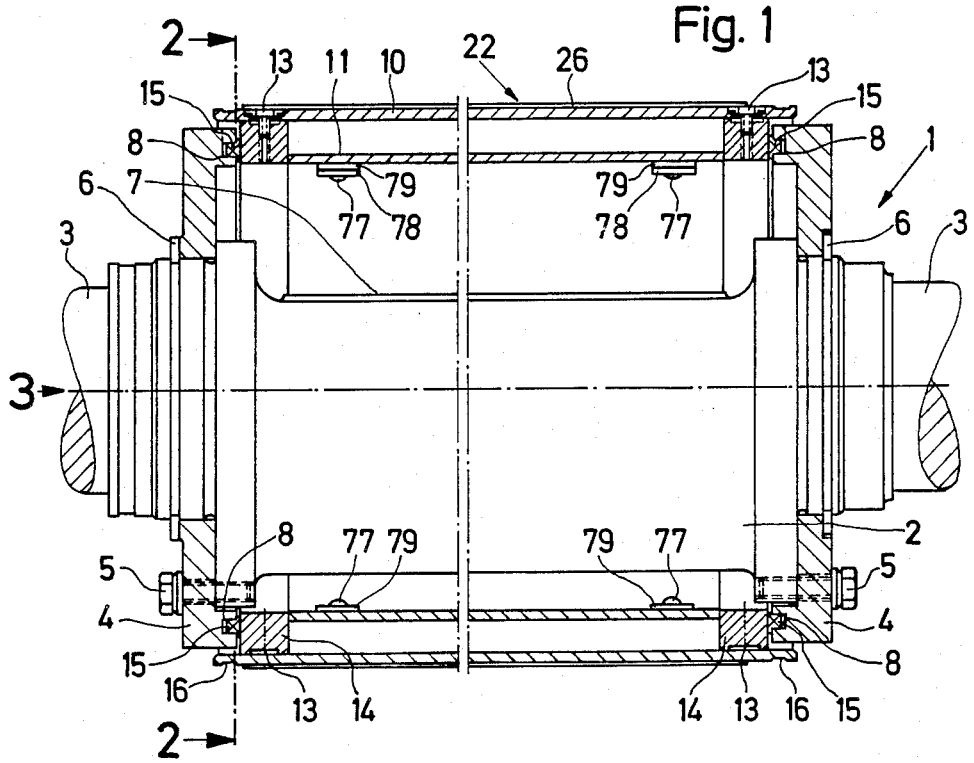
FIG. 1 is a longitudinal sectional view of a sheet transfer cylinder constructed in accordance with the invention.

Referring now to the drawing and first, particularly, to FIG. 1 thereof, there is shown a sheet transfer cylinder 1 with a cylinder body 2 having shaft journals 3 mounted in non-illustrated side walls of the printing machine. In the vicinity of the shaft journals 3 on both sides of the cylinder body 2, support discs 4 are mounted on the cylinder body and fixed in position by means of mounting bolts 5 and retaining rings 6, or fastened to the cylinder body 2. The upper surface of the cylinder body 2 has a flat section 7 which, as shown especially in FIG. 2, provides space for a gripper device. The radially outer region of each support disc 4 has in the longitudinal direction of the cylinder, inwardly directed concentric locating grooves 8, which extend almost over the entire circumference and serve to receive therein jacket segments 22 to 24 which form the cylinder jacket.

These jacket segments 22 to 24 are formed of a radially outer jacket 10, as well as an inner jacket 11, which are connected to one another by means of connecting webs 12. Ring segments 14 arranged on both sides of and also secured by means of screw connections 13 to the jacket 10 have (axially) two outwardly directed guide cams (15) which engage in the locating grooves 8 of the support discs 4. The jacket 10 correspondingly dimensioned in the longitudinal direction of the cylinder has, at its ends, circular ring grooves 16 which serve, particularly during the printing process, to prevent soiling of the inner regions of the sheet transfer cylinder 1.

FIG. 2 illustrates the distribution of the individual jacket segments 22 to 24 in the direction of the circumference of the cylinder. A bracket 18 is attached to the flat section 7 of the cylinder body 2 by mounting bolts 17. The bracket 18 carries a gripper support 19 for grippers 20 which are arranged on a gripper bridge 21 having a non-illustrated conventional actuation and movement mechanism which is not discussed in detail in this description. The cylinder jacket 10 of the illustrated embodiment is formed by a total of three jacket segments 22 to 24 i.e. by a gripper segment 22, a middle segment 23 and an end segment 24, respectively extending over the entire length of the sheet transfer cylinder 1. The end segment 24 is provided with an additional clamping device 25 in order to clamp a covering 26 over the entire sheet-bearing area of the three jacket segments 22 to 24.

Figure 3:
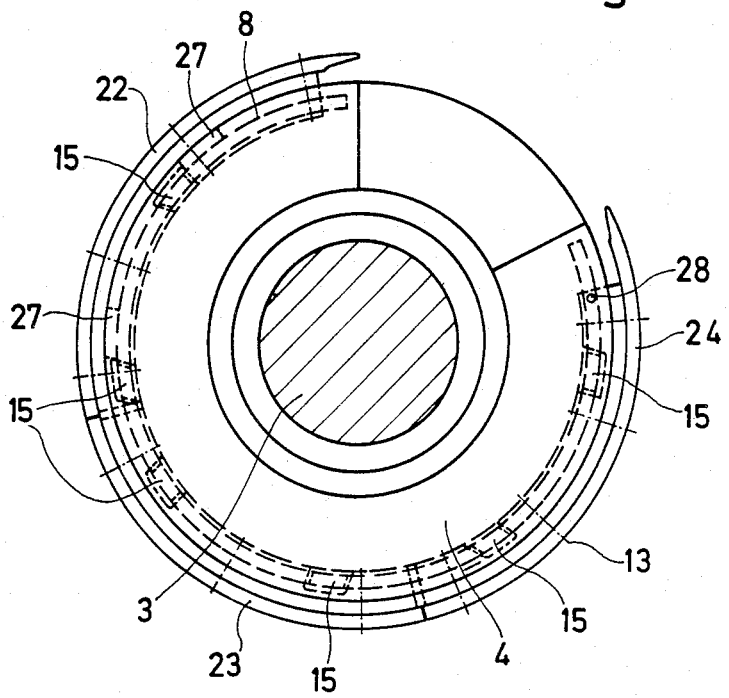
FIG. 3 is a side view of FIG. 1 as seen in direction of the arrow 3.

As shown in FIG. 3, the locating grooves 8 of the support discs 4 are formed in the vicinity of the gripper segment 22 with two radially outwardly directed entry slots 27 through which the guide cams 15 can be inserted in the locating grooves 8. Each of the jacket segments 22 to 24 has two guide cams 15 which are spaced, respectively, an equal distance from one another. The entry slots 27 are also arranged and dimensioned, respectively, in accordance with the width of the guide cams 15 and the spacing thereof from one another.

Figure 6:
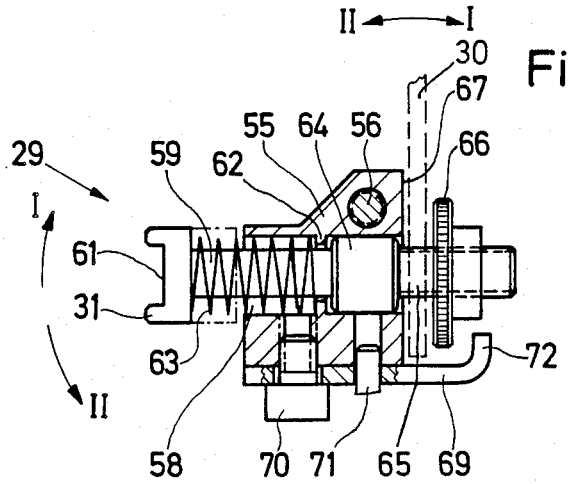
FIG. 6 is an enlarged fragmentary view of FIG. 2 showing a turnbuckle forming part of the invention.
Figure 7:
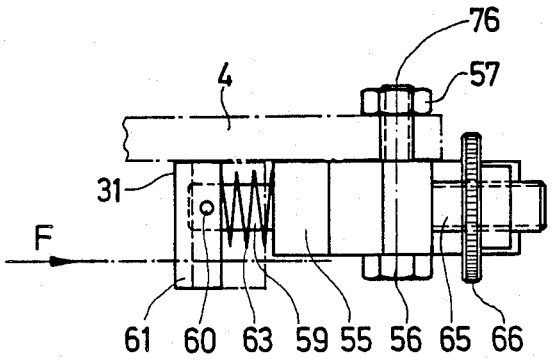
FIG. 7 is a top plan view of FIG. 6.
Figure 8:
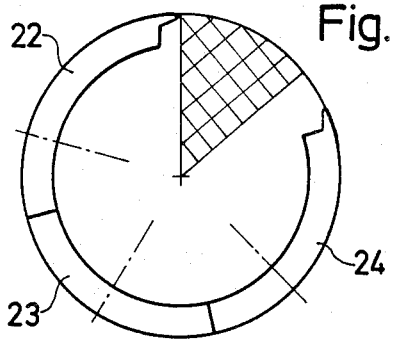

The individual jacket segments 22 to 24 are assembled as follows:

Initially, the end segment 24 is inserted through the entry slot 27 into the locating grooves 8 and shifted in these grooves 8 to the position on the circumference of the cylinder jacket limited by stops 28 of the support discs 4. The middle segment 23 is then inserted and, in a suitable manner, brought to rest on the previously inserted end segment 24. Finally the gripper segment 22 is inserted. In the vicinity of the first guide cam 15, so-called turnbuckles 29 (shown in FIG. 2) which are actuated by a clamping lever 30 are then fastened to both sides of the sheet transfer cylinder 1 and to the support discs 4. A spring-loaded clamping plate 31 of each turnbuckle 29 presses against the guide cam 15 so that, in accordance with the transmission of the spring forces, all of the jacket segments 22 to 24 are pressed against the stops 28 and thereby definitely positioned. FIG. 2 shows the operating position of the turnbuckle 29 in solid lines, while the representation of the release position thereof which can be adjusted by means of the clamping lever 30 for assembling and disassembling the individual jacket segments 22 to 24 is in phantom. An enlarged view of the turnbuckle 29 is shown in FIGS. 6 and 7.

The jacket segments 22 to 24 are dismantled in reverse sequence.

For this purpose, belts 78 and 79 are associated on both sides with each inner jacket 11 from the middle segment 23 and the end segment 24 and fastened to it at one end by means of rivets 77, while the other end of each belt 78, 79, respectively, is suspended on a pin 80 which is applied to the flat section 7 on the cylinder body 2 in the vicinity of the gripper segment 22 and the gripper device 18 to 21.

After disassembling the gripper segment 22, without rotating (inch mode) the entire sheet transfer cylinder 1, the remaining jacket segments 23, 24 can be conveniently pulled by the machine operator to the corresponding position (radial entry slots) for removal.

FIG. 4 shows a further embodiment of the invention with a different configuration of the sheet-bearing cylinder jacket. The turnbuckle 29 as well as the entire gripper device correspond to the devices shown in FIG. 2 so that further details thereof need not be provided in this regard. Also, in this embodiment, the cylinder jacket carrying the sheet is formed of three jacket segments 32 to 34 which can once again be designated in sequence as the gripper segment 32, the middle segment 33 and the end segment 34. In this regard, the paper sheet is not supported over a large area, but rather, only at points, for example, by using rowels 35 generally known in the state of the art. The construction of the previously mentioned jacket segments 32 to 34 is apparent from the view of one of these segments shown in FIG. 5.

The jacket segment 32 extending over the entire length of the sheet transfer cylinder 1 is formed of two mutually connected segment sections 36, 37, in the form of frames, two correspondingly curved discs 38, 39 being provided and being lined via connecting webs 40, 41, for example by means of welded joints 42.

The flushly aligned connection between both segment sections 36 and 37 is provided by means of correspondingly arranged connecting bolts 43 with locknuts 44 and intermediate fitting parts or spacers 45.

A further disc element 48, 75, which carries the guide cam 15, is secured, respectively, by means of a screw connection 46 and a positioning pin 47 to each disc 38 with which the axially outwardly disposed carrier discs 4 shown in FIG. 1 are associated. In this way, the jacket segments 22 to 24, in accordance with the embodiment thereof shown in FIGS. 1 to 3, can be replaced alternatively by one or more of the jacket segments 32 to 34 in accordance with the embodiment thereof shown in FIGS. 4 and 5.

For clarification purposes, in FIG. 5 a respective one of the rowel devices provided in a prescribed number thereof is shown for each segment section 36, 37. Each rowel 35 is mounted on a bearing bushing 49 which is arranged on a carrier rod 50 so that it is axially shiftable. Several rowels 35 with corresponding bearing bushings 49 are, of course, arranged on one carrier rod 50. The latter has locking pins 51 at each end thereof which engage in corresponding holes 52 formed in the discs 38, 39. The position of each carrier rod 50 is determined by a compression spring 53 which is supported on the disc 39 and on a collar 54 of the carrier rod 50.

Assembly and disassembly of the aforedescribed jacket segments 32 to 34 occurs analogously with the assembly and disassembly of the embodiment according to FIGS. 1 to 3.

However, belts in accordance with the embodiment shown in FIGS. 1 to 3 are not necessary for the dismantling or disassembling because, due to the different construction thereof, the jacket segments 33, 34 make it easier for the machine operator to grasp them and to move them into the corresponding position.

The FIGS. 6 and 7 shown, in an elevational view and a corresponding top plan view, an enlarged detail of FIG. 1 showing the aforedescribed turnbuckle 29.

The turnbuckle 29 is formed of a turnbuckle body 55 which is rotatably fastened by means of a bolt 56 with a locknut 57 to the support disc 4, with the longitudinal axis 76 of the bolt 56 forming the axis of rotation. A clamping rod 59 projects through a bore 58 formed in the turnbuckle body 55. The clamping rod 59 has, at its one end, the aforementioned clamping plate 31 and is connected therewith by a pin 60. A recess 61 formed in the clamping plate 31, in which each guide cam 15 engages, prevents the turnbuckle 29 from releasing unintentionally. A compression spring 63 supported on a collar 62 of bore 58 provides the necessary force (see effective curve or reaction force F). The middle clamping-rod part 64 formed with a somewhat thicker diameter serves as a guide in the bore 58. The other end thereof has a thread 65 on which a knurled nut 66 is screwed. The fork-shaped clamping lever 30 engages in the intermediate space between the knurled nut 66 and the end face 67 of the turnbuckle body 55 and, with the aid thereof, the turnbuckle 29 can be turned about its axis of rotation (the longitudinal axis of the bolt 76) in the directions I and II of the curved double-headed arrow shown in FIG. 6. In this regard, it is noted that when the clamping lever 30 swings, it is supported, respectively on the end face 67 of the turnbuckle body 55 as well as on the knurled nut 66. A correspondingly directed torque thereby occurs about the longitudinal axis of the bolt 76. Furthermore, the spring-loaded clamping rod 59 is pulled to the right, and the turnbuckle 29 can engage and disengage, respectively.

A plate 69 is secured by a bolt 70 and a positioning pin 71 to the underside of the turnbuckle body 55 and is formed with an end piece 72 bent at an angle of 90° which cooperates with the knurled nut 66 in the manner described hereinafter.

In operating position, the turnbuckle 29 must be prevented from releasing unintentionally or of its own accord. Furthermore, gravitational forces in the direction of the circumference of the cylinder should be prevented from occurring as a result of accelerations or decelerations of the rotational motion of the cylinder. Such gravitational forces would otherwise completely act upon the compression spring 63, which would compress, resulting in relative movement of the jacket segments 22 to 24 and 32 to 34. For this purpose, the knurled nut 66 in the engaged, clamped position of the turnbuckle 29 is turned on the thread 65 and thereby moved to the right-hand side until it comes to rest on the end piece 72. This absorbs the gravitational force, the system remains rigid, and the jacket segments remain in their position. The possibility that the clamping plates 31 might be released, which could only occur by an axial movement of the clamping rod 59 towards the right-hand side, is thereby excluded.

Figure 9:
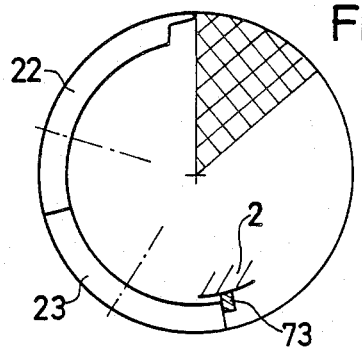
Figure 10:
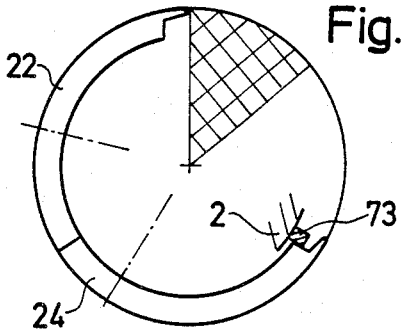
Figure 11:
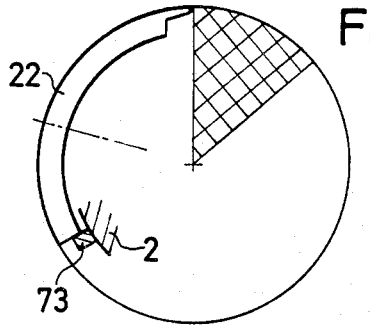

FIGS. 8 to 17 show in highly diagrammatic form a number of possible arrangements and selective options with respect to the configuration of the sheet-bearing cylinder jacket of the sheet transfer cylinder 1. The cross-hatched circular segment represents the gripper channel. The arrangement shown in FIG. 8 corresponds to the embodiment according to FIGS. 1 to 3. In FIG. 9, the sheet-bearing cylinder jacket is shown only with the gripper segment 22 and the middle segment 23 which, due to the omitted end segment 24, is limited on both sides with regard to the end position thereof by stops 73, which can be secured to the cylinder body 2 per se or to the support discs 4 not shown in FIG. 9. The embodiment according to FIG. 10 has a gripper segment 22 and an end segment 24, again requiring that the stop 73 be attached. The same construction applies to FIG. 11, wherein only the gripper segment 22 forms the cylinder jacket. This can prove totally adequate depending upon the paper format to be processed.

Figure 12:
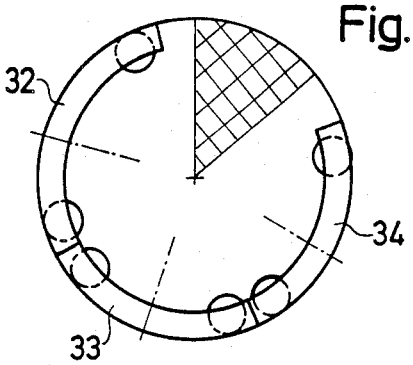
Figure 13:
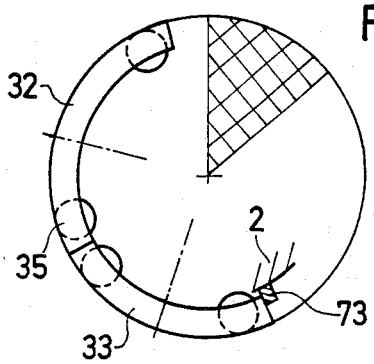
Figure 14:
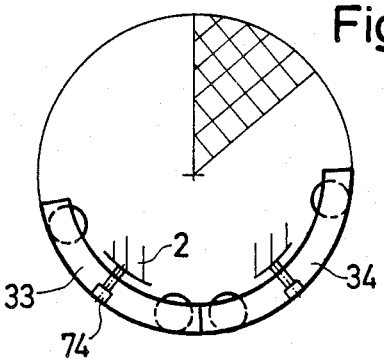

The embodiment according to FIG. 12 corresponds to the embodiment shown in FIG. 4. FIG. 13 shows the jacket segments 32 and 33 equipped with rowels 35. A corresponding stop 23 is therefore also necessary in this case. Also, in the embodiment according to FIG. 14, only two jacket segments 33 and 34 are used, in this case being formed of the middle segment 33 and the end segment 34 at the indicated positions thereof. In principle, it is possible to effect a positioning in any desirable arbitrary position by means of locking screws 74 which clamp the jacket segments 33 and 34, for example, against the cylinder body 2.

Figure 15:
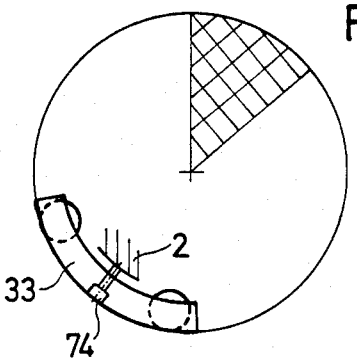

In FIG. 15, only the middle segment 33 is shown which is also fixed by means of a locking or stop screw 74.

Figure 16:
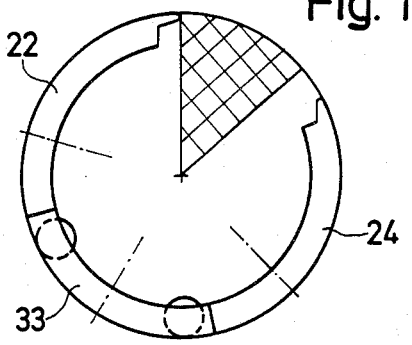
FIGS. 8 to 17 are highly diagrammatic end views of sheet transfer cylinders respectively formed with a different number and type of the cylinder jacket segments.

FIG. 16 shows a combination of jacket segments 22 and 24 with closed jacket surfaces and a jacket segment (the middle segment 33) which is equipped with rowels 35.

Figure 17:
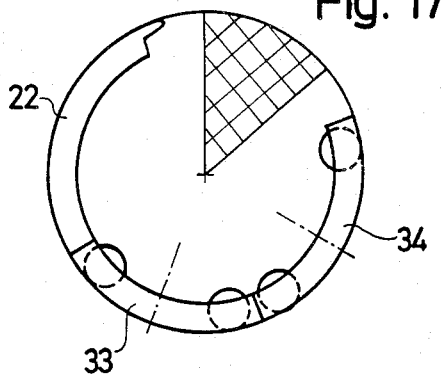

Finally, FIG. 17 also shows such a combination but in this case, only the gripper segment 22 has a closed jacket surface, while the remaining segments i.e. the middle segment 33 and the end segment 34 have rowels 35.

As mentioned hereinbefore, the invention is of course not limited to the described embodiments and combinations, but rather includes all possible variations resulting from the inventive concept. The construction of the jacket segments with the inventive assembly mechanism permits the use of that version or embodiment which best suits the relevant operating conditions.

The foregoing is a description corresponding, in substance, to German application No. P 34 30 131.3, dated Aug. 16, 1984, International priority of which is being claimed for the instant application, and which is hereby made part of this application. Any material discrepancies between the foregoing specification and the specification of the aforementioned corresponding German application are to be resolved in favor of the latter.

There are claimed:

1. In sheet-fed rotary printing machines, a sheet transfer cylinder having a sheet-bearing cylinder jacket formed of a plurality of jacket segments arranged next to one another in circumferential direction of the cylinder, the jacket segments extending at least over a sheet-bearing circumferential area of the sheet transfer cylinder, comprising locking elements located at respective ends of the jacket segments and engaging in corresponding receiving elements on end surfaces of the cylinder, said locking elements being a pair of guide cams located at each end of the jacket segments, and said receiving elements being receiving grooves formed concentrically in a support disc defining an end surface of the cylinder, said guide cams being guided in circumferential direction of the cylinder and lockable in said receiving grooves.

2. Sheet transfer cylinder according to claim 1 including radial entry slots for facilitating the insertion of said guide cams in said receiving grooves formed in said support discs at both ends of the cylinder, said radial entry slots, respectively, being arranged in accordance with the spacing and the width of said guide cams.

3. Sheet transfer cylinder according to claim 1 including stationary stop means at which each of the jacket segments guided in said receiving grooves is bringable to rest.

4. Sheet transfer cylinder according to claim 1 including a previously inserted one of the jacket segments at which each of the remaining jacket segments guided in said receiving grooves is bringable to rest.

5. Sheet transfer cylinder according to claim 1 including locking elements via which each of the jacket segments is fixable at a given location of the circumference of the sheet transfer cylinder.

6. In a sheet-fed rotary printing machine, a sheet transfer cylinder having a sheet-bearing cylinder jacket formed of a plurality of jacket segments arranged next to one another in circumferential direction of the cylinder, the jacket segments extending at least over a sheet-bearing circumferential area of the sheet transfer cylinder, comprising guide cams located at respective ends of the jacket segments and engaging in corresponding receiving grooves formed concentrically in respective support discs defining end surfaces of the cylinder said guide cams being guided in circumferential direction of the cylinder and lockable in said receiving grooves, the jacket segments forming the cylinder jacket being mutually exchangeable.

7. Sheet transfer cylinder according to claim 6 wherein the jacket segments forming the cylinder jacket are of like type with respect to the sheet-carrying area thereof and are mutually exchangeable.

8. Sheet transfer cylinder according to claim 6 wherein the jacket segments forming the cylinder jacket are of different types with respect to the sheet-carrying area thereof and are mutually exchangeable.

9. Sheet transfer cylinder according to claim 6 wherein the sheet-bearing circumferential area is on a part of the jacket segments and constitutes a surface closed upon itself.

10. Sheet transfer cylinder according to claim 6 wherein the sheet-bearing circumferential area is on a part of the jacket segments constructed so as to bear the sheet only on given points.

11. Sheet transfer cylinder according to claim 6 wherein the cylinder jacket is formed of an arbitrarily selected sequence and number of the jacket segments defining a closed surface having points thereon on which exclusively the sheets are supported.

12. Sheet transfer cylinder according to claim 9 wherein each of the jacket segments is formed of a radially outer jacket and a radially inner jacket spaced from one another and mutually connected by a connecting web, and respective ring segments carrying said guide cams and being threadedly fastened to end faces of the cylinder jacket.

13. Sheet transfer cylinder according to claim 12 including a sheet gripping device mounted in a channel extending axially along the jacket segments and wherein respective belts are associated on both sides with each of said inner jackets of the jacket segments, and being fastened at one end thereof by rivets to said inner jackets and suspended at the other end thereof from a pin located in vicinity of said sheet gripping device.

14. Sheet transfer cylinder according to claim 10 wherein each of the jacket segments comprises a pair of mutually connected segment sections formed as a frame and including, respectively, two circular discs disposed at opposite sides of the jacket segments and being mutually secured by connecting webs, and a respective further disc carrying said guide cams, said further disc being fastened to at least one of said circular discs of each of said jacket segments.

15. Sheet transfer cylinder according to claim 14 wherein said two circular discs disposed at opposite sides of each of the jacket segments are formed with corresponding bores wherein locking pins of respective carrier rods are received, a plurality of sheet-bearing rowels being disposed on said carrier rods and being shiftable longitudinally via bearing bushings.

16. In a sheet-fed rotary printing machine, a sheet transfer cylinder having a sheet-bearing cylinder jacket formed of a plurality of jacket segments arranged next to one another in circumferential direction of the cylinder, the jacket segments extending at least over a sheet-bearing circumferential area of the sheet transfer cylinder, comprising guide cams located at respective ends of the jacket segments and engaging in corresponding receiving grooves formed concentrically in respective support discs defining end surfaces of the cylinder, said guide cams being guided in circumferential direction of the cylinder and lockable in said receiving grooves, and respective clamping devices assigned to each of said support discs for pressing the jacket segments against one another in circumferential direction of the cylinder and for pressing a last one of the jacket segments in a sequence of the jacket segments against respective stops.

17. Sheet transfer cylinder according to claim 16 wherein each of said clamping devices is constructed as a turnbuckle pivotable selectively about a given pivot axis into a release position permitting displaceability of the jacket segments in circumferential direction of the cylinder and into a working position wherein the jacket segments are pressed by spring bias against corresponding stops.

18. Sheet transfer cylinder according to claim 17 wherein said turnbuckle has a spring-loaded clamping plate pressing against said guide cams, said turnbuckle has a stop for preventing automatic release of said turnbuckle from said working position thereof and for absorbing inertial forces directed in circumferential direction of the cylinder.

19. Sheet transfer cylinder according to claim 18 wherein said turnbuckle has a body rotatably fastened to the respective support disc by a bolt having a longitudinal axis corresponding to said pivot axis and a locknut threadedly received on said bolt, and a clamping rod projecting through a bore formed in said turnbuckle body, said clamping rod being formed with a recess and having said spring-loaded clamping plate at one end thereof and being formed with a thread at the other end thereof whereon a knurled nut is threadedly secured.

20. Sheet transfer cylinder according to claim 19 including a plate (69) fastened by a bolt and a positioning pin to an underside of said turnbuckle body and formed with an end piece bent perpendicularly to said plate and serving as a stop for said knurled nut, inertial forces present in the reaction force of the jacket segments being directly transmitted via said clamping plate, said clamping rod and said knurled nut to said end piece.

21. Sheet transfer cylinder according to claim 19 including a fork-shaped clamping lever receivable in an intermediate space between said knurled nut and an end face of said turnbuckle body for actuating said turnbuckle.

* * * * *